US008802991B1

(12) United States Patent
Hua et al.

(10) Patent No.: US 8,802,991 B1
(45) Date of Patent: Aug. 12, 2014

(54) TRAVEL POWER ADAPTER

(75) Inventors: Fang Hua, Hamilton (CA); Richard Teltz, Hamilton (CA)

(73) Assignee: Flextronics AP, LLC, Broomfield, CO (US)

( * ) Notice: Subject to any disclaimer, the term of this patent is extended or adjusted under 35 U.S.C. 154(b) by 295 days.

(21) Appl. No.: 12/792,583

(22) Filed: Jun. 2, 2010

Related U.S. Application Data

(60) Provisional application No. 61/183,407, filed on Jun. 2, 2009.

(51) Int. Cl.
*H01B 7/00* (2006.01)

(52) U.S. Cl.
USPC ..... 174/135; 439/501; 439/502; 439/135; 174/133 R; 174/68.1; 174/481

(58) Field of Classification Search
USPC ..... 361/820; 439/501, 50, 502, 135, 4, 1; 320/111; 191/12.4
See application file for complete search history.

(56) References Cited

U.S. PATENT DOCUMENTS 4,997,381 A * 3/1991 Oh ..... 439/172
5,923,146 A * 7/1999 Martensson ..... 320/111
6,402,546 B1 * 6/2002 Groves et al. ..... 439/501
6,428,348 B1 * 8/2002 Bean ..... 439/501
6,433,274 B1 * 8/2002 Doss et al. ..... 174/50
6,522,534 B1 * 2/2003 Wu ..... 361/679.4
6,623,294 B2 * 9/2003 Tse et al. ..... 439/501
6,705,891 B1 * 3/2004 Lin ..... 439/528
7,151,356 B1 * 12/2006 Chen ..... 320/107
7,175,473 B1 * 2/2007 Clapp et al. ..... 439/501
7,425,132 B2 * 9/2008 Yang et al. ..... 439/4
2003/0186581 A1 * 10/2003 Hsiao ..... 439/501
2004/0097126 A1 * 5/2004 Chen ..... 439/501
2004/0129522 A1 * 7/2004 Skowronski ..... 191/12.2 R
2005/0117376 A1 * 6/2005 Wilson ..... 363/142
2008/0053685 A1 * 3/2008 Chen et al. ..... 174/135
2008/0174265 A1 * 7/2008 Toya ..... 320/107
2009/0035986 A1 * 2/2009 Tracy et al. ..... 439/501

* cited by examiner

*Primary Examiner* — Tuan T Dinh
*Assistant Examiner* — Steven T Sawyer
(74) *Attorney, Agent, or Firm* — Haverstock & Owens LLP

(57) ABSTRACT

A power adaptor for portable electronic devices is positionable in an operational position and a travel position. In an operational position, an AC power connector is exposed for mating with a wall power plug. A DC power cable is extended from a spool. In a closed position, the AC power connector is retracted or removed. The DC power cable is wound around a spool and a cap is positioned thereon to cover the spool and DC power cable. What results is a sleek, featureless, outer surface in a closed position that makes the power adaptor easily stowed and transported.

10 Claims, 4 Drawing Sheets

TRAVEL POWER ADAPTER

RELATED APPLICATIONS

This application claims priority of U.S. provisional application Ser. No. 61/183,407, filed Jun. 2, 2009, and entitled "NOTEBOOK EZ PACK AND TRAVEL POWER ADAPTOR" by these same inventor. This application incorporates U.S. provisional application Ser. No. 61/183,407 in its entirety by reference.

FIELD OF THE INVENTION

The present invention relates to portable electrical devices. More particularly, the present invention relates to chargers for portable electric devices.

BACKGROUND

Portable electronic devices generally require power adaptors for charging or use. Power adaptors are given little design consideration. Many conventional power adaptors are bulky with large form factors, which make the power adaptors inconvenient for travel or to be carried by a user. The power cables associated with a power adapter often become tangled. FIG. 1 shows a common prior art power adaptor 100 for a portable computer. The power adaptor 100 has a housing 101 that houses a power converter (not shown). The power converter converts AC power from a wall power socket into an appropriate DC voltage for the portable computer. The AC is supplied by an AC power cable 105 that is electrically coupled to the power converter within the housing 101. The AC power cable 105 has an AC power connector 106 for electrical mating with a wall power socket. The power adaptor 100 further comprises a DC power cable 102. The DC power cable 102 has a DC connector 103 for electrically mating with a portable computer (not shown). Generally, the AC power cable 105 is on the order of 1 meter long. The DC power cable 102 is on the order of 2 meters long. When the power adaptor 100 is not being used, it is desirable to put the power adaptor 100 in as small a form factor as possible. To that end, some manufacturers provide some means for wrapping the AC power cable 105 and DC power cable 102 around the housing 101. In the example of FIG. 1, a common prior art solution is shown. Guiding rails 104 form a spool to wrap the AC power cable 105 and DC power cable 102 around the housing 101. The guiding rails 104 keep the AC power cable 105 and DC power cable 102 from slipping away from the housing 101. To secure the wrapped power cables in place, a belt 107 is provided. Several holes 108 are disposed on the belt 107 in a line so as to receive a boss 109 affixed to the housing 101. However, wrapping the cables 105 and 102 around the housing 101 forms a bulkier overall form factor. Rather than being convenient and portable, the power adaptor 100 becomes cumbersome and unwieldy. Generally, users of portable electronic appliances such as laptops prefer smaller form factors so that devices such as power adaptors are able to easily fit in a briefcase, backpack, or the like where space is limited. Furthermore, should the boss 109 or the belt 107 break, there is no way to secure the cables. What results is a messy and tangled web of cables. Other solutions include velcro belts for securing only the cables in a wrapped fashion, or removable cables which may result in lost cables.

SUMMARY OF THE INVENTION

What is provided is a power adaptor for a portable electronic device, such as a portable computer. The power adaptor has a spool for winding a power cable around, and a cap for covering and housing the spool. What results is a very neat and compact solution for stowing away the power cable during transport or when the power adaptor is otherwise not being used. The power adaptor can be configured to plug directly into a wall socket without an AC power cable by making use of a slidably movable AC power connector.

In one embodiment of the invention, a power adaptor comprises a power converter, an AC power connector for providing AC power from an AC power source, a DC power cable for delivering DC power from the power converter, and a housing. Preferably, the housing comprises a spool portion for receiving at least one of the AC power cable and the DC power cable in a wrapped fashion, and a cap portion for enclosing the spool portion. In some embodiments, the cap is slidably mounted along a shaft, wherein the shaft is integral to the spool. Preferably, the AC power connector is slidably coupled to the housing, such that a sliding actuator effectuates a sliding motion for exposing or retracting the AC power connector into the housing. Alternatively, the AC power connector is rotatably or removably coupled. In an operational form factor, the prongs of the AC power connector are exposed such that the adaptor is able to be plugged into a wall socket. In a travel form factor, the prongs are retracted, enabling a form factor with minimal protrusions for ease in carrying, packing, or stowing. In some embodiments, the cap is able to be positioned in an open position and a closed position. In an open position, the DC power cable is able to be wrapped around the spool for stowage. If an embodiment where an AC power cable is used, the AC power cable is able to be wrapped around a separate spool. In some embodiments, both the AC power cable and DC power cable are wrapped around the same spool. Preferably, the cap comprises a first notch corresponding to a thickness of the DC power cable such that the DC power cable is able to be outstretched while the cap is in a closed position. In some embodiments, the cross section of the housing is an arcuate shape, such as circle, oval, or the like. Alternatively, the cross section is a linear shape, such as a square or a rectangle. Other features and advantages of the present invention will become apparent after reviewing the detailed description of the embodiments set forth below.

BRIEF DESCRIPTION OF THE DRAWINGS

The accompanying drawings, which are incorporated in and form a part of this specification, illustrate embodiments of the invention and, together with the description, serve to explain the principles of the invention, but not limit the invention to the disclosed examples. The drawings may not be to scale and may represent complex elements in simplified views.

The present invention is described relative to the several views of the drawings. Where appropriate and only where identical elements are disclosed and shown in more than one drawing, the same reference numeral will be used to represent such identical elements.

DETAILED DESCRIPTION OF THE PRESENT INVENTION

Reference will now be made in detail to the embodiments of the power adaptor, examples of which are illustrated in the accompanying drawings. While the invention will be described in conjunction with the embodiments below, it will be understood that they are not intended to limit the invention to these embodiments and examples. On the contrary, the invention is intended to cover alternatives, modifications and equivalents, which may be included within the spirit and scope of the invention as defined by the appended claims. Furthermore, in the following detailed description of the present invention, numerous specific details are set forth in order to more fully illustrate the present invention. However, it will be apparent to one of ordinary skill in the prior art having the benefit of this disclosure that the present invention may be practiced without these specific details. In other instances, well-known methods and procedures, components and processes haven not been described in detail so as not to unnecessarily obscure aspects of the present invention. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
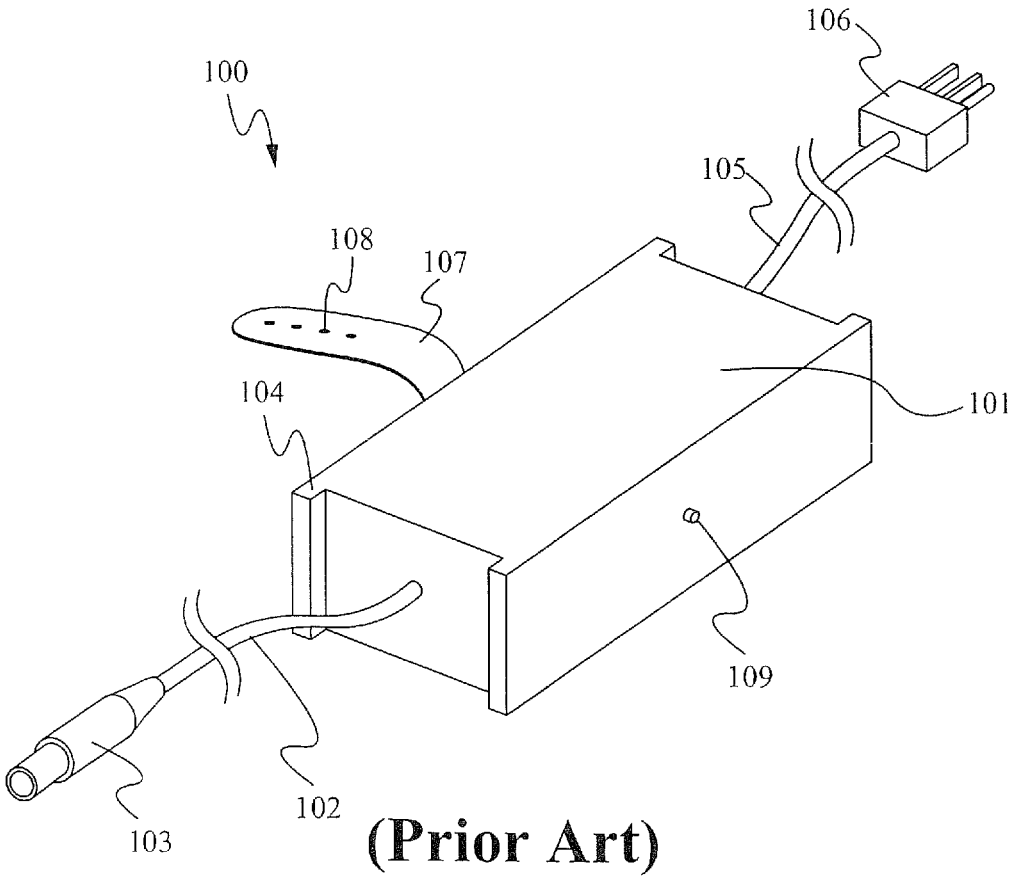
(Prior Art) Fig. 1
FIG. 1 is a prior art power adaptor for a portable electronic appliance.
Figure 2A:
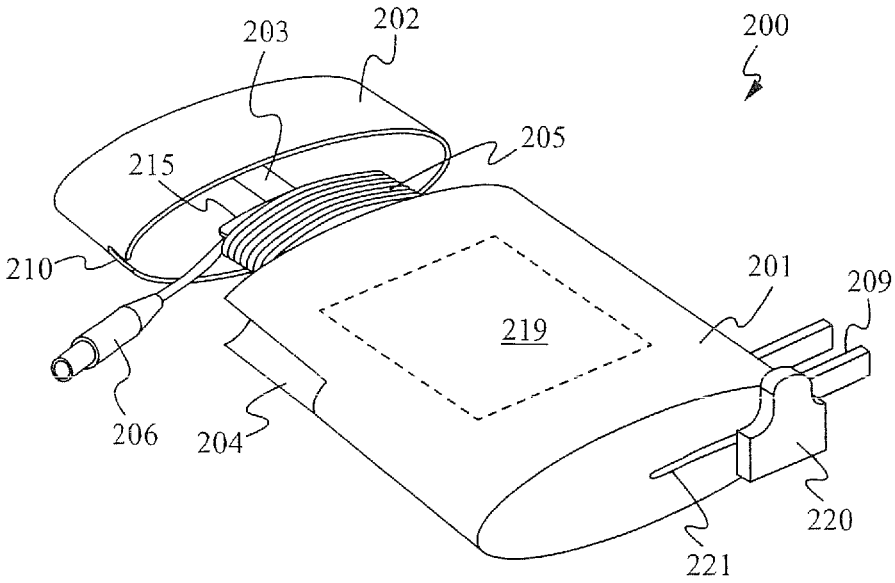
FIG. 2A is an exemplary embodiment of a power adaptor in an open position per an embodiment of the current invention in an operational form factor.
Figure 2B:
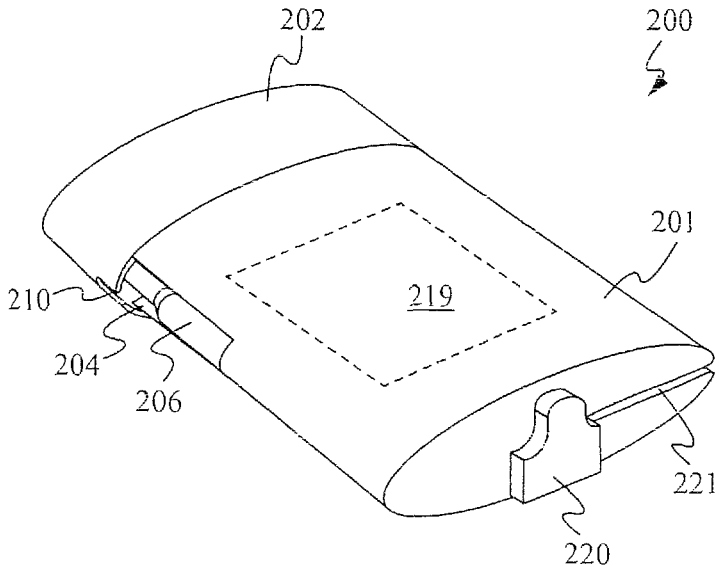
FIG. 2B is an exemplary embodiment of a power adaptor in a closed position per an embodiment of the current invention in a compact form factor.

FIGS. 2A and 2B show a novel power adaptor 200 per an embodiment of this invention in an open, or operational position and a closed, or travel position respectively. FIG. 2A shows the open position. The power adaptor 200 has a housing 201. In this exemplary embodiment, the housing has a an ovoid cross section. The housing 201 houses a power converter 219 shown in phantom view. The power converter 219 can be a switching type power converter, a linear converter, or any other type of known, convenient or application specific power converter. The power converter 219 is electrically coupled to an AC power connector 209. The AC power connector 209 is preferably a standard form factor for coupling with a wall power socket. The power converter 219 converts AC power, 120V AC in the United States, into an appropriate desired DC power for a portable appliance. The housing 201 supports a spool 215. The spool 215 is of an appropriate size and shape such that a DC power cable 205 can be wrapped around it. The DC power cable 206 is electrically coupled to the power converter 219 for providing DC power from the power converter 219 to a portable electrical appliance (not shown). To that end, the DC power cable 205 comprises a DC power jack 206 for mating with an appropriate power socket on the portable electrical appliance. In an open position, the power adaptor 200 can be plugged directly into a wall power socket via the AC power connector 209, and the DC power cable 205 can be unraveled from the spool 215 so that the DC power jack 206 can mate with a portable electrical appliance for use or charging. To that end, a cap 202 for covering the spool 215 is opened to allow the DC power cable 205 to be extended for use. In some embodiments, the cap is left open during use. Alternatively, a notch 210 is provided on a surface of the cap 202 to allow the cap 202 to close while the DC power cable 205 remains extended, allowing for a smaller operational form factor. Still alternatively, a notch (not shown) on a surface of the housing 201 can also be formed to allow the DC power cable 205 to remain extended while the cap 202 is closed.

In FIG. 2B, the power adaptor 200 is in a closed, or travel position. In a closed position, the power adaptor 200 is preferably in the smallest possible form factor with no protrusions, bulges, or the like. Advantageously, the small form factor makes the power adaptor 200 convenient to carry or stow away. Prior art solutions, as mentioned above, suffer from an inherent drawback of having either the AC or DC power cables, or both, wrapped around a body of the power adapter for travel and stowing. What results is an item that is difficult to fit in a pocket or compartment of a briefcase, backpack, or the like, and becomes even more unwieldy and cumbersome in a pocket of a garment such as a jacket or pants pocket. To that end, the AC power connector 209 (FIG. 2A) is slidably mounted to the housing 201. A sliding actuator 220 can be manually manipulated by a user to extend the power jack 209 in an operational form factor or retract the power jack 209 in a travel form factor. A sliding path 221 is provided to mechanically couple the sliding actuator 220 to the power jack 209 for extension and retraction. Also, the cap 202 is slidably mounted to the housing 201 by a shaft 203. The cap 202 is fixed to an end of the shaft 203 and a user is able to manually open and close the cap 202 without the cap 202 being lost. Also, the housing 201 comprises a holster 204 for receiving the DC power jack 206. Preferably, the holster 204 is configured such that when the DC power jack 206 is stowed inside, what results is a sleek outer surface. As shown in FIG. 2B, the power adapter 200 has a smooth and sleek outer surface nearly devoid of features. What results is a power adapter 200 that fits conveniently into most pockets of attire or a briefcase or backpack. There are no protrusions for tangling with other items in a traveler's possession.

Figure 3A:
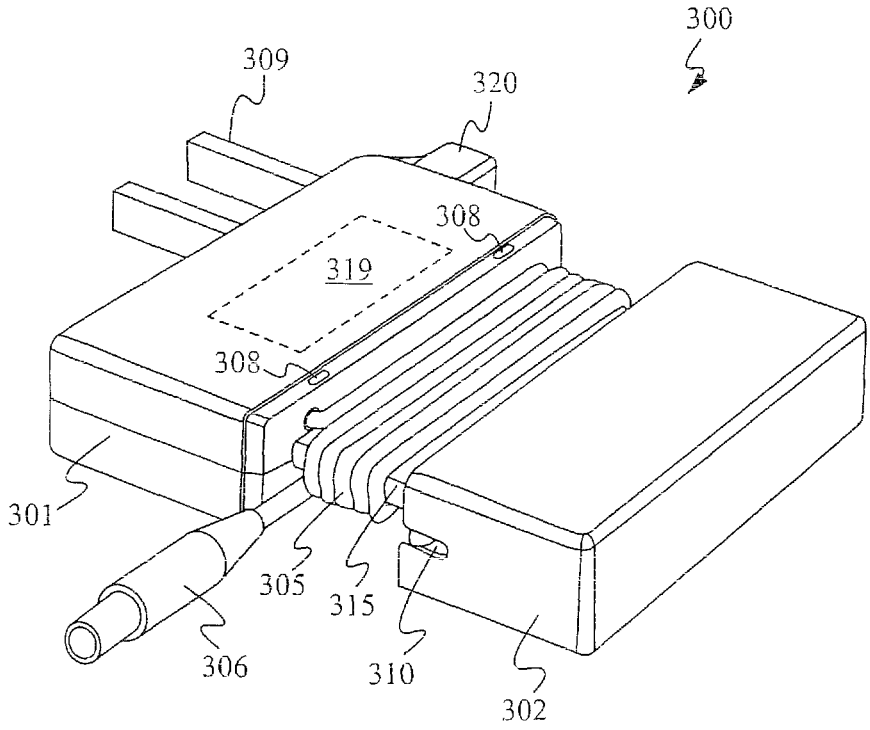
FIG. 3A is an exemplary embodiment of a power adaptor in an open position per an embodiment of the current invention in an operational form factor.
Figure 3B:
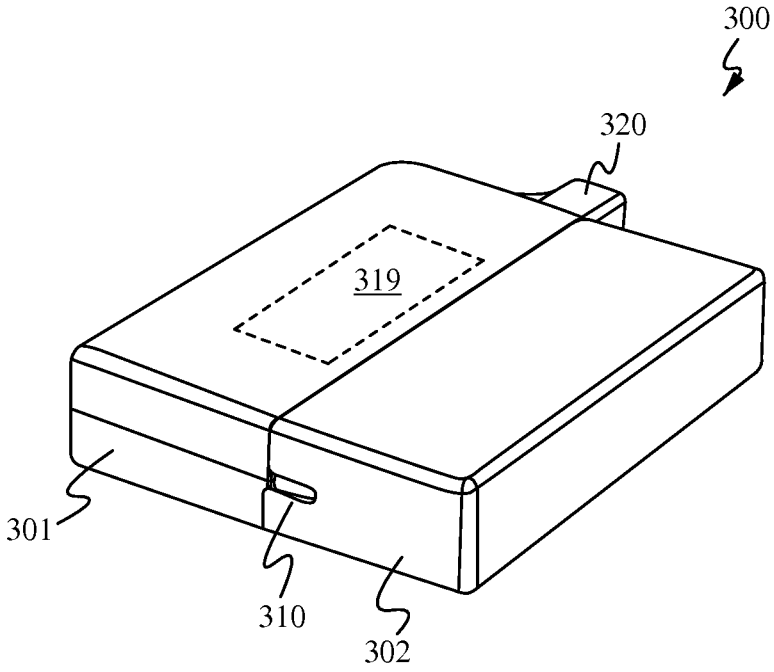
FIG. 3B is an exemplary embodiment of a power adaptor in a closed position per an embodiment of the current invention in a compact form factor.

FIGS. 3A and 3B show a power adapter 300 per another embodiment of the current invention. FIG. 3A shows the power adapter 300 in an open, or operational form factor. The power adapter 300 comprises a housing 301. In this exemplary embodiment, the power housing has a linear, rectangular shaped cross section versus the ovoid cross section of the previous embodiment. The person of ordinary skill having the benefit of this disclosure will appreciate that the cross section can be any combination of linear and arcuate features such as squares, rectangles, circles and ovoids. In an open position, a cap 302 is position to allow a DC power cable 305 to be unwound from a spool 315. The DC power cable comprises a DC power jack 306 for mating with an appropriate socket in a portable electrical appliance. The DC power cable 305 is electrically coupled to a power converter 319 shown in phantom view. The AC power converter 319 converts power coupled from an AC wall socket by an AC power connector 309 into useful DC power. The cap 302 can be left open in an operational form factor to allow the DC power cable 305 to extend to the portable electrical appliance while the power adapter 300 is plugged into a wall socket. Alternatively, the cap 302 is closed and the DC power cable 305 is extended through a notch 310 in the cap 302.

Figure 4:
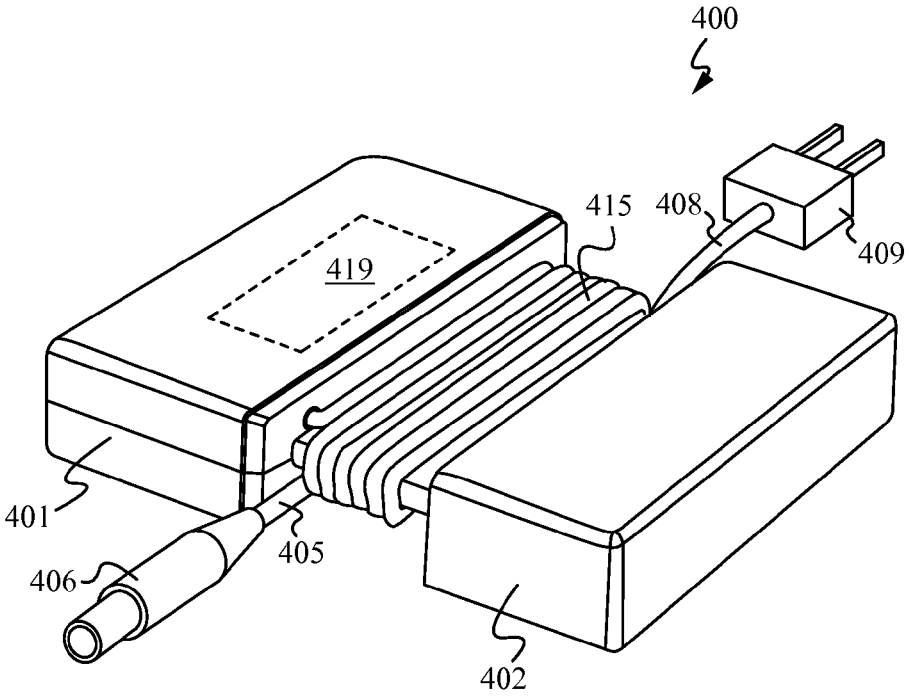
FIG. 4 is an exemplary embodiment of a power adaptor per an embodiment of the current invention in an operational form factor.
Figure 5:
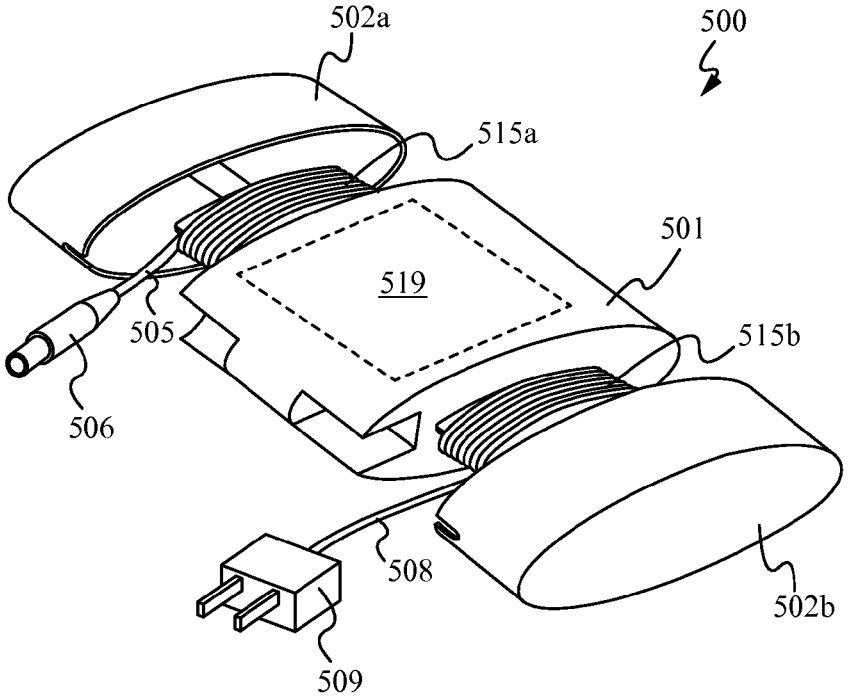
FIG. 5 is an exemplary embodiment of a power adaptor per an embodiment of the current invention in an operational form factor.

In FIG. 3B, the power adaptor 300 is shown in a closed position, or travel position. In a closed position, the power adaptor 300 is in the smallest possible form factor. The cap 302 is slidably mounted and closes over the spool 315 (FIG. 3A) and the wrapped DC power cable 305 (FIG. 3A). In this embodiment, the DC power jack 306 fits inside the cap 302 for stowing away during travel. The housing 301 further comprises latching insets 308 (FIG. 3A) for receiving latching protrusions (not shown) on an inside surface of the cap 302 for securing the cap 302 in place during transport. The person of ordinary skill in the art having the benefit of this disclosure will readily appreciate alternative means and assemblies for securing the cap 302 to the housing 301, including but not limited to an external latch, a screw on cap, or the like. In the closed position, the AC power connector 309 is retracted inside the housing 301. To that end, a sliding actuator 320 that is mechanically coupled to the AC power connector 309 is provided to effectuate retraction and protraction of the AC power connector 309. Although sliding motions have generally been discussed herein to describe the AC power connector 309, the person of ordinary skill having the benefit of this disclosure will recognize that other configurations, such as removably coupling or rotatably coupling with a knob will achieve the desired result of hiding away the AC power connector 309 in a closed position. Alternatively, an AC power connector is able to be electrically coupled to the power converter by an AC power cable, as illustrated in FIGS. 4-5. In some embodiments, as illustrated in FIG. 4, an AC power cable 408 is coupled with an AC connector 409 and is preferably positioned such that the AC power cable 408 is able to be wrapped around the same spool as thea DC power cable 405 which is coupled with a DC power jack 406. As illustrated in FIG. 4, the AC power cable 408 and the DC power cable 405 are both able to wrap around the spool 415 that is coupled with a body 401. The body 401 houses a power converter 419. A cap 402 is slidably mounted and closes over the spool 415. Still alternatively, as illustrated in FIG. 5, a second spool 515*b* can be provided for wrapping an AC power cable 508 around, and a second cap 502*b* for covering the second spool 515*b*. The AC power cable 508 is coupled with an AC connector 509. A first spool 515*a,a* first cap 502*a* are both similarly configured as the spool 205 and the cap 202 of FIG. 2A. A DC power cable 505 is coupled with an DC power jack 506 and is able to wrap around the spool 515*a*.

A power adaptor as described in this disclosure is able to be positioned in an "operational" or "open" form factor and a "travel" or "closed" form factor. In an open form factor, the user is able to plug the adaptor directly into a wall power socket and extend the DC power cable to the portable electrical appliance, such as a portable computer. In a closed form factor, the power adaptor has a sleek, featureless outer surface for easy stowing in a briefcase, backpack, or a garment pocket. Because of it sleek and featureless outer surface, the power adapter does not clutter or interfere with other items. Because the cables are wrapped around a spool and stowed away, there are no cables that must be accounted for, tucked away, or otherwise dealt with. The present invention has been described in terms of specific embodiments incorporating details to facilitate the understanding of the principles of construction and operation of the invention.

The specific configurations shown in relation to the various modules and the interconnections there between are for exemplary purposes only. Such reference herein to specific embodiments and details thereof is not intended to limit the scope of the claims appended hereto. It will be apparent to those skilled in the art having the benefit of this disclosure that modifications may be made in the embodiment chosen for illustration without departing from the spirit and scope of the invention.

What is claimed is:

1. A power adaptor comprising:

a. a power converter within a housing, the housing including:

1. a shared exposable spool extending from an end of the housing when the power adaptor is both in an operational position and a travel position, wherein the spool is for winding at least two power cables around the spool; and 2. a holster located therein;

b. a DC power cable electrically coupled with the power converter;

c. a cap for covering the spool, wherein the cap is movably coupled along a shaft away from and towards the spool; and d. an AC power cable electrically coupled with the power converter and an AC connector;

wherein the DC power cable and the AC power cable both exit the housing adjacent to a portion of the spool that is exposed when in the operational position such that the DC power cable and the AC power cable can both be manually wrapped around the exposed portion of the spool.

2. The power adaptor of claim 1, wherein the holster is configured to receive a DC power jack electrically coupled with the DC power cable.

3. The power adaptor of claim 1, wherein the holster is configured such that when the DC power jack is stowed, the DC power jack is stowed in a position substantially parallel to an open-close motion of the cap.

4. The power adaptor of claim 1, wherein the holster is configured such that when the DC power jack is stowed, the DC power jack is stowed in a position substantially parallel to and against an inner side edge of the housing.

5. The power adaptor of claim 1, wherein the cap has a notch for receiving the DC power cable therethrough.

6. The power adaptor of claim 1, wherein the holster is located along an inner edge of the housing.

7. The power adaptor of claim 1, wherein the housing includes latching insets for receiving latching protrusions on an inside surface of the cap.

8. The power adaptor of claim 5, wherein the notch in the cap aligns with the holster in the housing.

9. The power adaptor of claim 7, wherein the latching insets are located along an outer perimeter of a sunken area of the housing, wherein the sunken area of the housing mates with the cap.

10. A power adaptor comprising:

a DC power cable;

an AC power cable;

a power converter electrically coupled with the DC power cable and the AC power cable;

a body for housing the power converter, wherein the body includes a first end and a second end opposite the first end;

a first spool for wrapping the DC power cable around, wherein the first spool extends from the first end of the body;

a first cap for covering the first spool, wherein the first cap is movably coupled with the body by a first shaft positioned within the first spool;

a second spool for wrapping the AC power cable around, wherein the second spool extends from the second end of the body; and a second cap for covering the second spool, wherein the second cap is movably coupled with the body by a second shaft positioned with the second spool.

* * * * *